US007932850B1

(12) United States Patent
Hochschild, III et al.

(10) Patent No.: US 7,932,850 B1
(45) Date of Patent: Apr. 26, 2011

(54) BUOYANT TARGET WITH RADAR REFLECTIVITY

(75) Inventors: Arthur Anton Hochschild, III, Garden Grove, CA (US); Roman Horeczko, Huntington Beach, CA (US); Arthur Anton Hochschild, IV, Tustin, CA (US)

(73) Assignee: Arthur Anton Hochschild, III, Garden Grove, CA (US)

( * ) Notice: Subject to any disclaimer, the term of this patent is extended or adjusted under 35 U.S.C. 154(b) by 0 days.

(21) Appl. No.: 12/790,518

(22) Filed: May 28, 2010

(51) Int. Cl.
*H01Q 15/00* (2006.01)

(52) U.S. Cl. ..... 342/8; 342/5; 342/7; 342/9; 342/10

(58) Field of Classification Search ..... 342/5, 7–10; 343/915

See application file for complete search history.

(56) References Cited

U.S. PATENT DOCUMENTS

| | | | | | |
|---|---|---|---|---|---|
| 2,534,716 | A * | 12/1950 | Hudspeth et al. | ..... | 441/20 |
| 2,888,675 | A * | 5/1959 | Pratt et al. | ..... | 342/8 |
| 3,224,001 | A * | 12/1965 | Radnofsky et al. | ..... | 342/8 |
| 3,671,965 | A * | 6/1972 | Rabenhorst et al. | ..... | 342/8 |
| 3,806,927 | A * | 4/1974 | Lane, Jr. | ..... | 342/7 |
| 4,673,934 | A * | 6/1987 | Gentry et al. | ..... | 342/8 |
| 4,733,236 | A * | 3/1988 | Matosian | ..... | 342/7 |
| 4,901,081 | A * | 2/1990 | Bain et al. | ..... | 342/8 |
| 4,980,688 | A * | 12/1990 | Dozier, Jr. | ..... | 342/9 |
| 5,457,472 | A * | 10/1995 | Bjordal et al. | ..... | 343/912 |
| 5,969,660 | A * | 10/1999 | Veazey | ..... | 342/8 |
| 6,300,893 | B1 * | 10/2001 | Schaff et al. | ..... | 342/10 |
| 6,384,764 | B1 * | 5/2002 | Cumberland | ..... | 342/8 |
| 6,570,545 | B1 * | 5/2003 | Snow et al. | ..... | 343/915 |
| 6,592,416 | B1 * | 7/2003 | Hochschild, III | ..... | 441/20 |
| 6,784,825 | B1 * | 8/2004 | Kubota et al. | ..... | 342/5 |

OTHER PUBLICATIONS

*Anonymous*, Documentation for Davis "Echomaster", Sep. 1, 2009 (3 sheets).

* cited by examiner

*Primary Examiner* — Thomas H Tarcza
*Assistant Examiner* — Peter Bythrow
(74) *Attorney, Agent, or Firm* — Squire, Sanders & Dempsey (US) LLP

(57) ABSTRACT

A buoyant target comprises an inflatable structure with a drogue chute attached to the periphery of the bottom of the inflatable structure. The drogue chute is an open flexible structure with a bottom end weighted with ballast to deploy it, and with ports through its side to permit water to flow into and out of it. A radar reflector device is attached inside the inflatable structure. The radar reflector device comprises a plurality of mutually orthogonal radar reflective surfaces having central reflection vectors pointed at predetermined directions.

19 Claims, 8 Drawing Sheets

BUOYANT TARGET WITH RADAR REFLECTIVITY

FIELD OF THE INVENTION

This invention relates generally to a target for gunfire training and, more particularly, to a buoyant, inflatable target with radar reflectivity. The invention is optionally used for "man overboard" training exercises.

BACKGROUND OF THE INVENTION

Naval battle exercises involve shipborne weapons and floating targets to be hit by gunfire. It is often desired that the targets simulate the size and/or movement of boats and other floating objects. A problem associated with such targets is that they must often be large in size, which makes providing a large number of "hard targets" impractical. To address this, it is common practice to provide buoyant, inflatable and collapsible structures for targets. Such targets can be folded to a relatively small size so that many can be stored and quickly inflated to full size on the water.

Buoyant and inflatable targets, however, are susceptible water currents and waves, and more particularly to the wind, also known as set and drift, which cause the targets to move in a manner that does not properly simulate movements of a true battle target. Anchors or drogue chutes are often added to the targets to prevent or inhibit excessive movement. Many conventional drogue chutes cannot be emptied to permit convenient target recovery. Proper sea anchors take time and experience to rig and launch, and the anchor line and commercial sea anchors cost money. Many times a makeshift sea anchor is improperly rigged using a weighted ammunition shell casing or ammunition box full of scrap metal. These types of sea anchors drop directly below the target balloon and exert too much resistance in heavy seas, resulting in damage to the target balloon before it can serve its intended purpose.

Increasingly, gunnery exercises involve the use of radar to sight in gunnery radar, thereby raising the need for an inflatable target with enhanced radar reflectivity. Prior attempts to increase radar reflectivity included mixing metal shavings with a viscous liquid, such as oil, and pouring the mixture inside the inflated target. A problem with this approach is that the metal shavings can provide insufficient reflectivity, especially when the shavings settle to the bottom of the target over time. Metallic sheet materials have also been attached on the exterior of an inflatable target to increase radar reflectivity. A problem with this approach is that the metallic material, due to its electrical conductive properties, could present an electrical hazard during deployment and/or retrieval of the target on the deck of a ship. Other approaches involving metal plates have the disadvantage of puncturing the inflatable target and making the target top heavy or unwieldy during deployment and retrieval of the target.

Accordingly, there is a continuing need for an inflatable floating target that closely simulates the movement of a body of substantial mass and stability so as to establish a more accurate test of a trainee's gunnery skills, maintains a generally upright orientation, and which has enhanced radar reflectivity.

Radar reflective targets are used to sight in and reconcile the accuracy of a ship's gunnery radar. Accuracy must be validated to insure that calibration is correct. To do this, one needs to fire weapons using the radar.

SUMMARY OF THE INVENTION

Briefly and in general terms, the present invention is directed to a buoyant target with radar reflectivity.

In aspects of the present invention, a target comprises an inflatable structure formed of a flexible material that allows the inflatable structure to expand from a collapsed state to an inflated state. The target further comprises a radar reflector device disposed inside the inflatable structure, the radar reflector device comprising a plurality of 3-surface orthogonal reflectors configured to reflect a radar signal.

In other aspects, a target comprises an inflatable structure configured to expand from a collapsed state to an inflated state when filled with gas. The target further comprises a radar reflector device disposed within the inflatable structure, the radar reflector device comprising three mutually orthogonal and intersecting planes, the planes configured to reflect a radar signal, the planes forming a plurality of orthogonal reflectors.

The features and advantages of the invention will be more readily understood from the following detailed description which should be read in conjunction with the accompanying drawings.

DETAILED DESCRIPTION OF THE INVENTION

Figure 1:
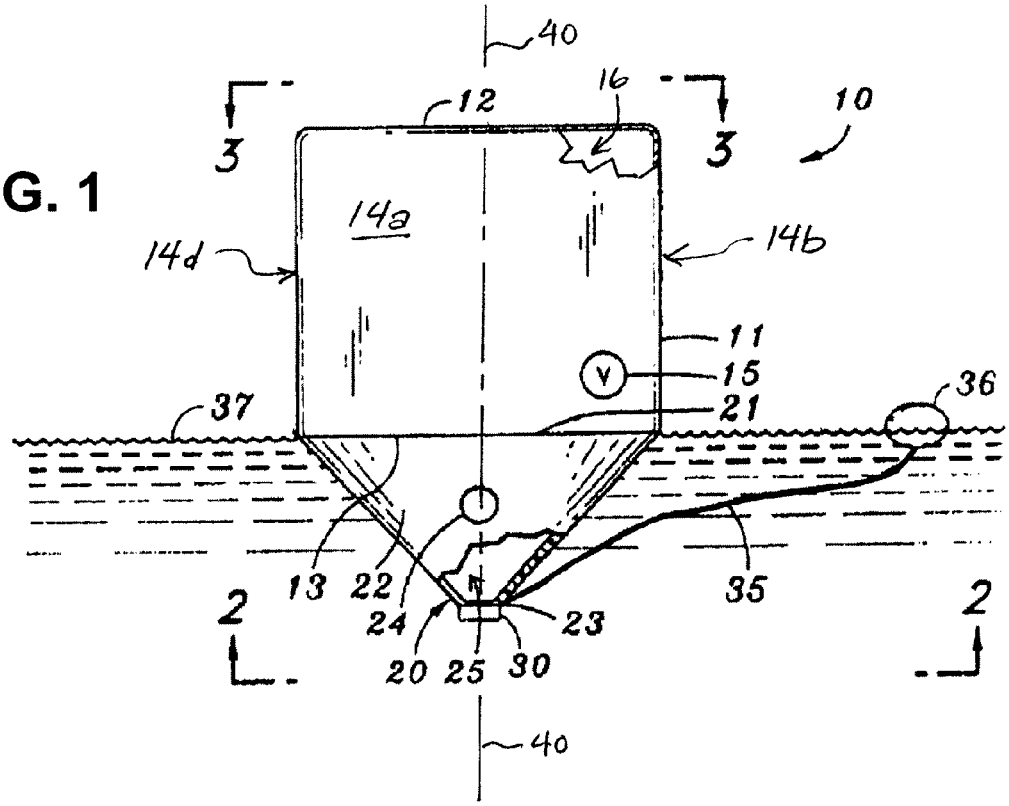
FIG. 1 is a front elevation of a buoyant target in its deployed configuration, showing a partial cutaway view near the bottom and the top of the target, wherein the side and rear elevations are identical.
Figure 2:
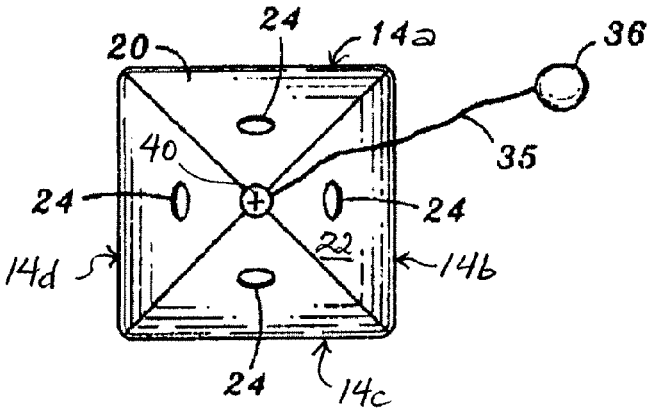
FIG. 2 is a bottom view taken at line 2-2 in FIG. 1, showing four apertures for allowing water to fill a drogue chute attached to a bottom end of the buoyant target.
Figure 3:
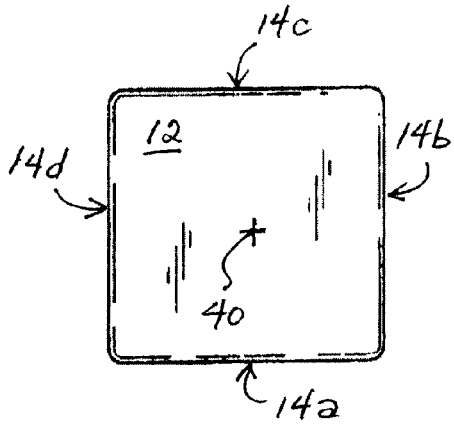
FIG. 3 is a top view taken at line 3-3 in FIG. 1, showing a top panel connected above front, rear, left and right panels.

Referring now in more detail to the exemplary drawings for purposes of illustrating embodiments of the invention, wherein like reference numerals designate corresponding or like elements among the several views, there is shown in FIGS. 1-4 a buoyant target 10 made of a flexible membrane material so it can be collapsed and folded to a small bulk. Part of the buoyant target 10 can be inflated for deployment on water. The membrane material is impermeable to the inflating gas. Suitable materials include without limitation polyvinyl chloride and polyethylene sheeting, which are preferable because structural seams can be heat sealed, solvent sealed, or cemented as desired.

The buoyant target 10 has an inflatable structure 11 that comprises a top panel 12, a bottom panel 13 and a sidewall 14 which enclose an air-filled chamber 16 upon deployment. The inflatable structure is substantially airtight. The sidewall 14 is rectangular and has a front panel 14*a*, a right panel 14*b*, a rear panel 14*c*, and a left panel 14*d*. Instead of being rectangular, the sidewall can be circular in other embodiments.

As shown in FIG. 1, a valve 15 in one of the sidewall panels is provided to enable the inflatable structure 11 to be inflated or deflated as needed. A drogue chute 20 is attached to the bottom panel 13 of the inflatable structure 11, which stabilizes the inflatable structure and prevents the it from tipping over of tilting excessively due to wave motion and wind. An upper edge 21 of the drogue chute preferably conforms to and is attached to the perimeter of the sidewall 14 and bottom panel 13. The drogue chute 20 is a flexible structure formed from material identical to or similar to that of the inflatable structure to allow the drogue chute to be folded for storage, and unfolded when the buoyant target is deployed.

Still referring to FIG. 1, the deployed drogue chute 20 is preferably tapered. The deployed drogue chute 20 comprises a tapered sidewall 22 that converges toward a lower end 23. The lower end 23 is aligned with the central axis 40 of the inflatable structure 11. The central axis 40 is located at substantially equal distances from the front panel 14*a*, the right panel 14*b*, the rear panel 14*c*, and the left panel 14*d* of the sidewall. The tapered sidewall 22 of the drogue chute 20 is pyramidal. Other tapered shapes for the sidewall 22 are possible, including without limitation a conical shape.

The tapered sidewall 22 and the bottom panel 13 of the inflatable structure 11 enclose a chamber 25 which fills with water upon deployment of the buoyant target 10. A plurality of apertures or ports 24 are formed through the tapered sidewall 22 of the drogue chute 20. The ports 24 are of sufficient diameter to permit some flow of water into and out of the chamber 25, but small enough to leave a sufficient area of material of the tapered sidewall 22 to engage water within the drogue chute chamber 25. The water within the drogue chute chamber 25 serves to stabilize the inflatable structure 11 above.

A weight 30 is fixed to the lower end 23 of the drogue chute 20. When the inflatable structure 11 is inflated and placed on water, the weight 30 will pull the drogue chute down to the pyramid shape. The chute will fill with water quickly, will stabilize the buoyant target so it rests upright in the water, and will resist movement by the wind and water current.

The drogue chute 20 functions as an anchor against drift caused by wind on the inflatable structure 11 while simultaneously allowing water current to pass through and/or around the drogue chute. Unlike conventional sea anchors, which have a parachute-like structure submerged in the water and connected by a line to a buoyant target, the drogue chute 20 inhibits movement of the buoyant target due to water current and wind. Another problem with conventional sea anchors is that they can drop downwardly and become a deadweight on the buoyant target, which might submerge the buoyant target and/or make recovery of the buoyant target difficult.

To facilitate recovery of the buoyant target 10, a flexible, nylon rope or tow line 35 is optionally attached to the lower end 23 of the drogue chute 20 to allow a person to pull the lower end upward, tilting the buoyant target, and spilling the water that was in the drogue chute chamber 25 when the buoyant target is to be removed from the water. The inflatable structure 11 can then be deflated by opening the valve 15, and the fully collapsed target can readily be pulled aboard a ship. An optional float 36 is attached to the other end of the tow line 35. The float 36 keeps the other end of the tow line 35 near the water surface 37 to allow ready access to the tow line to start the process of recovering the buoyant target.

In some embodiments, the inflatable structure 11 is a 10-foot cube, the drogue chute 20 is a 3-foot high inverted pyramid extending upward from the lower end 23 to the bottom panel 13 of the inflatable structure 11, and the water flow-through ports 24 are about 6 inches in diameter and located on all four sides of the drogue chute pyramid. It will be appreciated that other dimensions may be implemented as desired to simulate a variety of battle targets.

Figure 4:
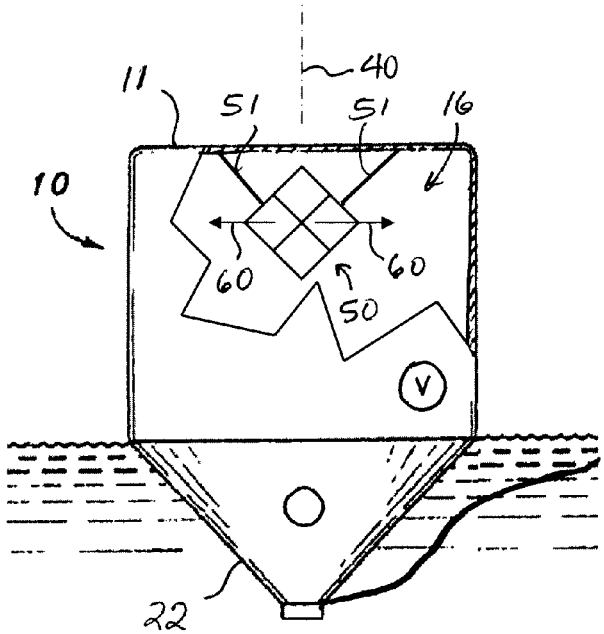
FIG. 4 is a front elevation view of the inflatable target of FIG. 1, showing a partial cutaway revealing a radar reflector device attached by securement lines to interior surfaces of the buoyant target.

As shown in FIG. 4, a radar reflector device 50 is secured within the air-filled chamber 16 of the inflatable structure 11. The radar reflector device is secured with a plurality securement lines 51, which can be a rope, cable, or other flexible cord. The other ends of the securement lines are fixed to the interior surfaces of the inflatable structure 11. When the inflatable structure 11 is fully inflated with gas, as shown in FIG. 4, the securement lines are taught and align the radar reflector device with the central axis 40 of the inflatable structure 11.

Figure 5:
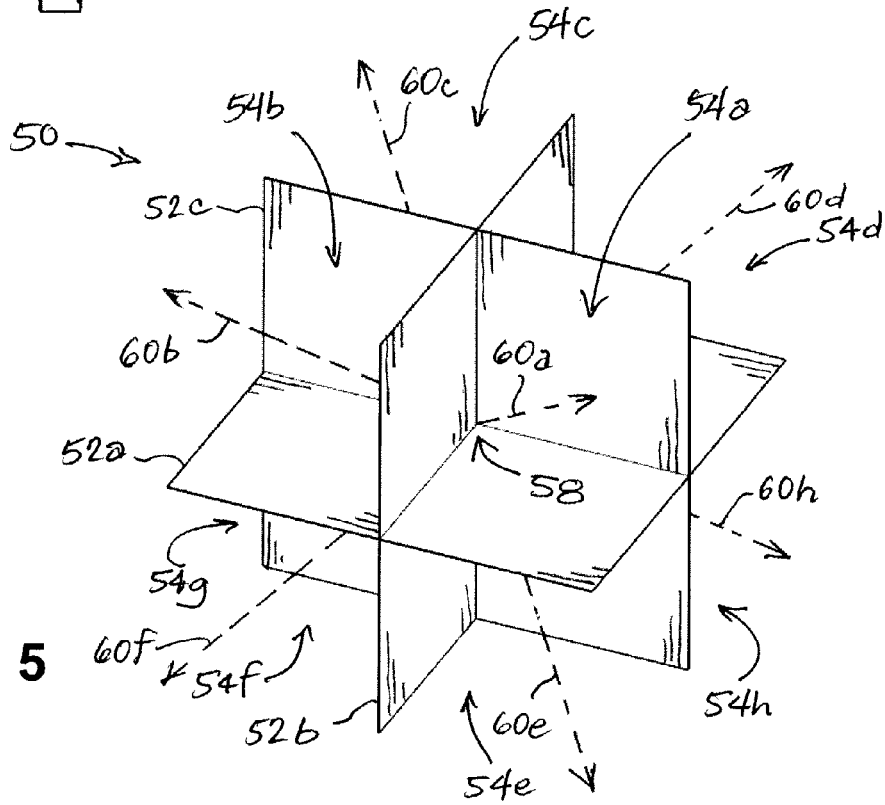
FIG. 5 is a perspective view of the radar reflector device of FIG. 4, showing eight 3-surface orthogonal reflectors formed by three mutually orthogonal and intersecting planes.

As shown in FIG. 5, the radar reflector device 50 comprises three mutually orthogonal sheets 52 of reflective material. As used herein, the phrase "mutually orthogonal" means that the referenced structures are substantially perpendicular to each other. It is to be understood that a condition modified by the word "substantially" or "substantial" is present in absolute or perfect form, as well as not necessarily absolute or perfect form but would be considered close enough to those of ordinary skill in the art to warrant designating the condition as still being present.

The sheets 52 of reflective material are substantially planar. One of the sheets 52*a* is illustrated horizontal and the other two sheets 52*b*, 52*c* are illustrated as vertical. The sheets 52 can have other orientations to facilitate reflection of a radar signal or other electromagnetic radiation transmitted from a particular direction relative to the buoyant target 10. The sheets can be rigid, radar-reflective metal plates, or plates of non-reflective material such as a plastic material or corrugated cardboard.

Each of the sheets 52 are squares, which give the radar reflector device 50 a cubic outline, though it will be appreciated that the sheets 52 can have other shapes. The cubic radar reflector device 50 comprises a total of eight groups 54*a*-54*f* of reflective surfaces 56. Each of the eight groups 54*a*-54*f* is a quadrant that comprises three radar reflective surfaces 56 that face each other and are mutually orthogonal, so as to form what is referred to herein as a 3-surface orthogonal reflector. The individual reflective surfaces 56 can be a metallic foil, metallic paint, or other radar reflective material that is laminated on, coated on, bonded on, imbedded in, or covered on the sheets 52. Mylar (R) can be used as a foil material. Optionally, the radar reflective surfaces 56 can be covered by a fabric or layer of soft material to prevent the radar reflector device 50 from cutting, puncturing, or otherwise damaging the inflatable structure 11

As used herein, the phrase "3-surface orthogonal reflector" is defined as three radar reflective surfaces that face each other and are mutually orthogonal. For each group 54*a*-54*f*, the three surfaces 56 are mutually orthogonal in that each surface is substantially perpendicular to the other two surfaces of the group. For clarity, a first of the 3-surface orthogonal reflectors 54*a* is illustrated in solid line and the other 3-surface orthogonal reflectors are illustrated in broken line in FIG. 6. In each 3-surface orthogonal reflector, the three mutually orthogonal surfaces 56 converge or intersect at a common central point 58.

As shown in FIG. 5, each of the 3-surface orthogonal reflectors 54*a*-54*h* has a central reflection vector 60*a*-60*h*. As used herein, the "central reflection vector" is defined as a straight line pointing in a particular direction. Each central reflection vector originates from the central point 58 of the respective 3-surface orthogonal reflector. The center points of the eight 3-surface orthogonal reflectors are mutually coincident or coincide at the overall center of the radar reflector 50. Thus, the central reflection vectors 60*a*-60*h* point radially outward at different directions from the center of the radar reflector device 50.

Figure 6:
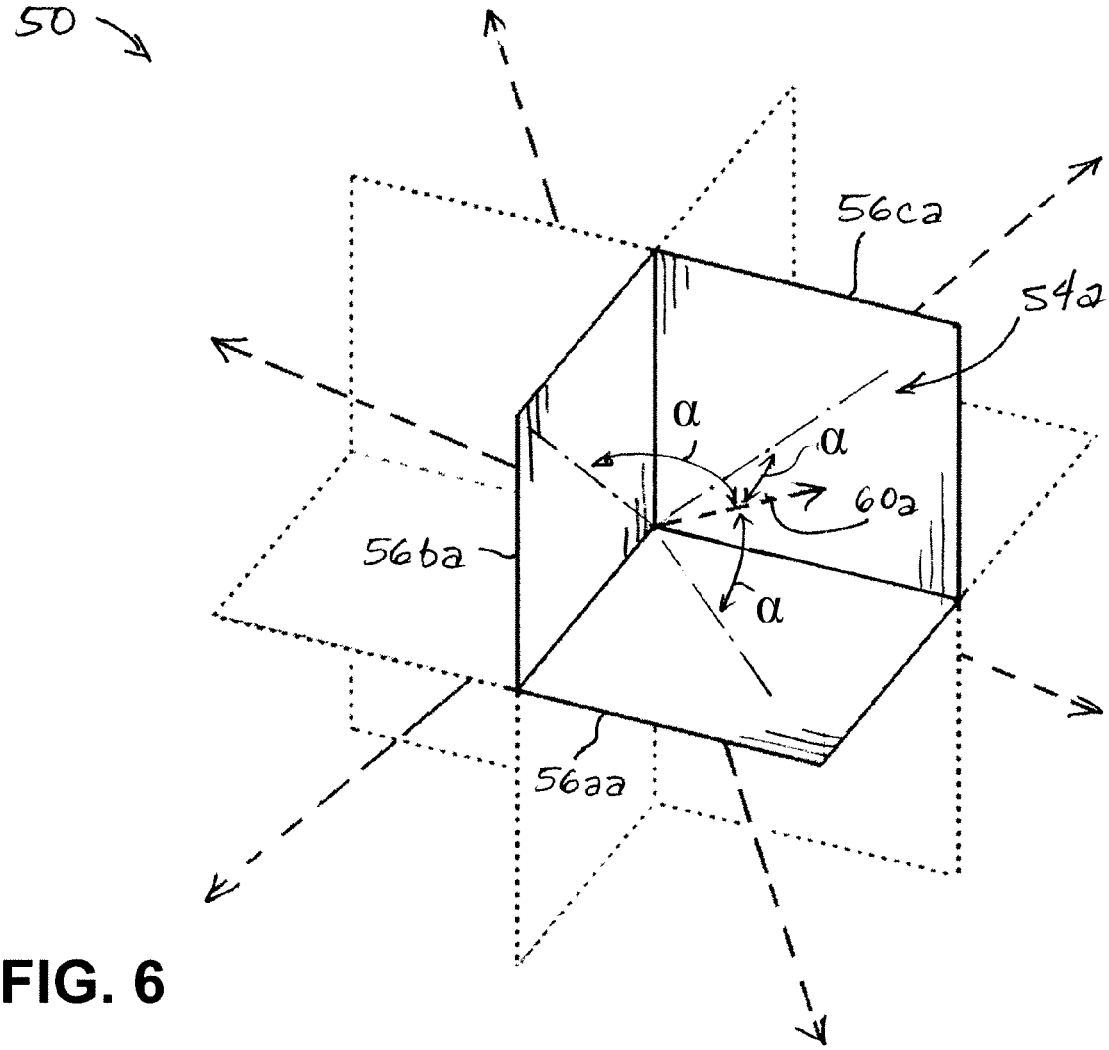
FIG. 6 is a perspective view of the radar reflector device of FIG. 4, showing three substantially planar surfaces, illustrated in solid line, of one of the eight 3-surface orthogonal reflectors.

The following description in connection with FIG. 6 for the central reflection vector 60*a* of the first 3-surface orthogonal reflector 54*a* also applies to the respective central reflection vectors of the other seven 3-surface orthogonal reflectors of the radar reflector device 50.

FIG. 6 shows the three mutually orthogonal surfaces 56*aa*, 56*ba*, 56*ca* of one of the 3-surface orthogonal reflectors 54*a*. The first planar surface 56*aa* is substantially perpendicular to the other two planar surfaces 56*ba*, 56*ca*. The central reflection vector 60*a* is oriented at substantially equal angles α relative to each of the three mutually orthogonal surfaces 56*aa*, 56*ba*, 56*ca*. That is, the central reflection vector 60*a* is oriented at or about forty-five degrees from the first planar surface 56*aa*, at or about forty-five degrees from the second planar surface 56*ba*, and at or about forty-five degrees from the third planar surface 56*bc*.

In some embodiments, some of the central reflection vectors 60 of the radar reflector device 50 are substantially horizontal when the inflatable target 10 is fully inflated and deployed, as shown in FIG. 5. Having at least some of the central reflection vectors 60 substantially horizontal allows for better reflection of electromagnetic radiation originating from ships on the water as compared to having none of the central reflection vectors 60 substantially horizontal.

Figure 7:
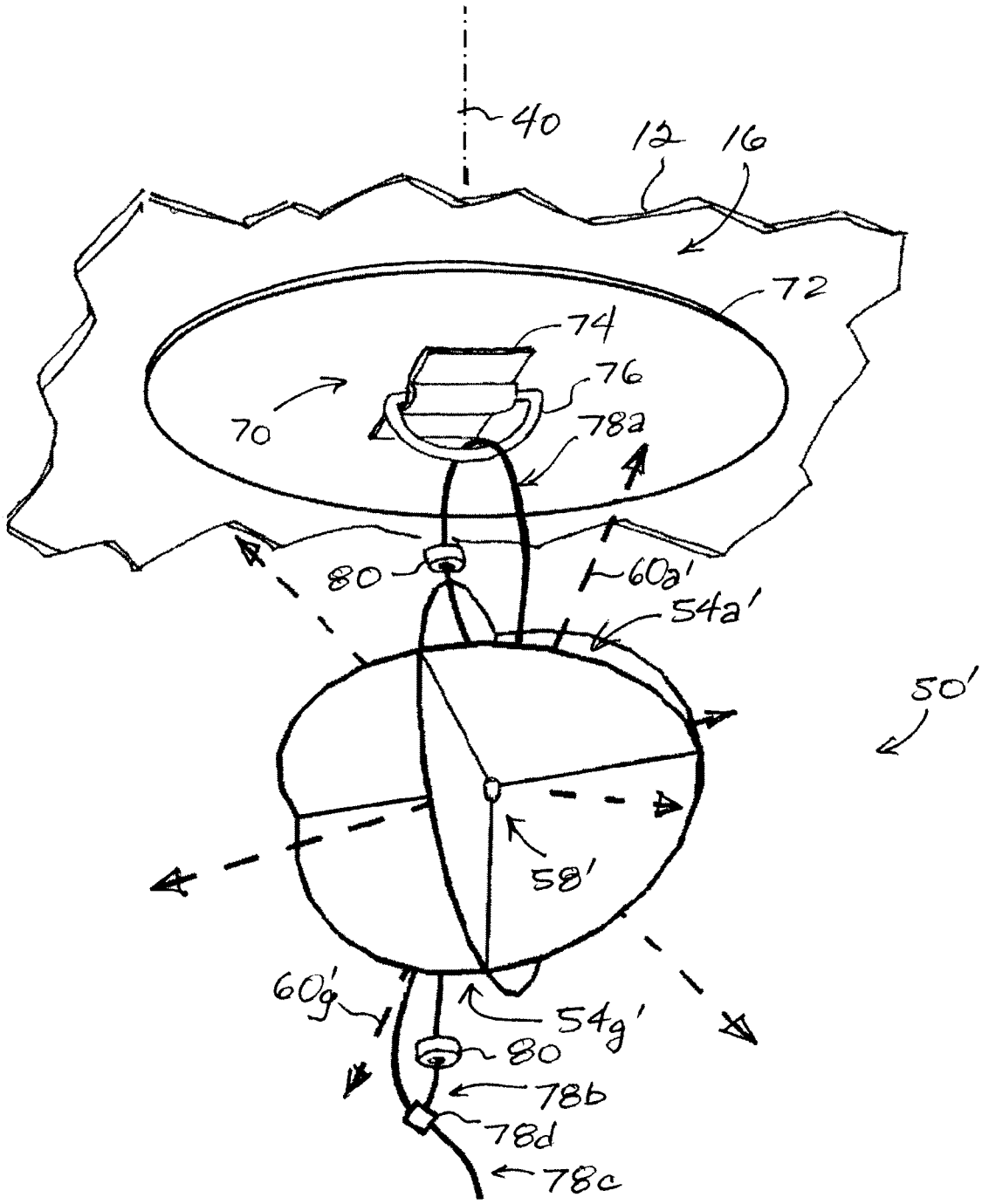
FIG. 7 is a cutaway, perspective view of a top panel of a buoyant target, showing a means for attaching a spherical radar reflector device to the target, the radar reflector being loosely connected to an interior surface of the buoyant target.

FIG. 7 shows another radar reflector device 50' for use in the inflatable target 10. The radar reflector device 50' comprises three mutually orthogonal sheets 52' of reflective material. The sheets 50' are substantially planar. The radar reflector device 50' has a spherical outline because the sheets 52' are circles. Suitable materials and construction of the sheets 52' can be the same as previously described above in connection with FIG. 5. The spherical radar reflector device 50' comprises a total of eight groups 54*a*'-54*f*' of reflective surfaces 56'. Each group comprises three mutually orthogonal surfaces that face each other so as to form a 3-surface orthogonal reflector. In each 3-surface orthogonal reflector, the three mutually orthogonal surfaces 56' converge or meet at a common central point 58.'

The spherical radar reflector device 50' is attached to the inner surface of the top panel 12 of the inflatable structure 11 and is disposed inside the air-filled chamber 16 when the buoyant target 10 is deployed for use. The area of attachment 70 is centered on the central axis 40 of the inflatable structure 11. There is a circular piece of reinforcement material 72 at the area of attachment 70. The reinforcement material 72 is bonded, welded or adhered to the inner surface of the top panel 12. Opposite ends of a strap 74 are bonded, welded or adhered to the bottom surface of the reinforcement material 72. The strap 74 attaches a D-ring 76 to the inflatable structure 11. A middle segment of the strap 74 forms a loop under the reinforcement material 72 and carries the D-ring.

An adjustable, flexible loop 78, such as thin rope, cord, or plastic wire tie, is strung through a hole at the center of the spherical radar reflector device 50' and through the D-ring 76. The flexible loop 78 is fed through the center hole of the radar reflector device in such a way that a loop segment 78*a*, which is looped around the D-ring 76, extends out from a first 3-surface orthogonal reflector 54*a*', and the free ends 78*b*, 78*c* extend out from another 3-surface orthogonal reflector 54*g*'. A one-way device 78*d* at one end 78*b* allows the other end 78*c* to move in only one direction, downward. Examples for the one-way device 78*d* include without limitation a slip knot that engages the other end 78*c* or a flexible ratchet device that engages rigid bumps arranged in series on the other end 78*c*. When the other end 78*c* is pulled through the one-way device 78*d*, the size of the flexible loop is reduced which moves the spherical radar reflector device 50' upward to the D-ring 76. The flexible loop 78 passes through the central holes of a pair of washers 80 made of rubber or elastomeric material. One washer is above and the other is below the radar reflector device 50'. The washers 80 prevent the flexible loop 78 from inadvertently pulling out of engagement with the radar reflector device 50'.

Figure 8:
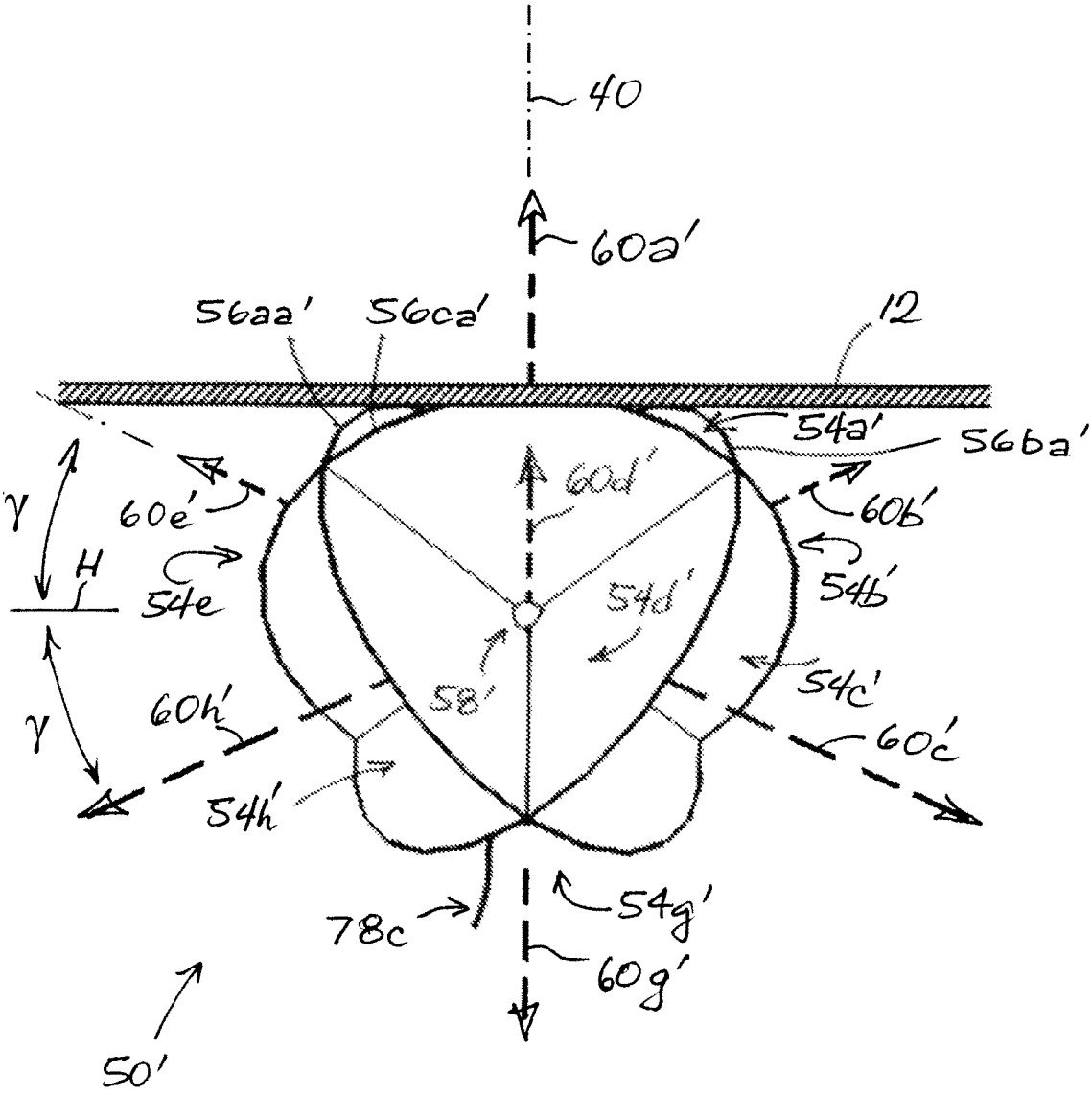
FIG. 8 is an elevation view of the top panel and buoyant target of FIG. 7, showing the means for attaching in a tightened state so that edges of the spherical radar reflector device are pulled into contact with the interior surface of the buoyant target.

In some embodiments, as shown in FIG. 8, the flexible loop 78 is tightened so that the first orthogonal reflector 54*a*' is covered by the top panel 12 of the inflatable structure 11. The top panel 12 abuts the edges of each of the three mutually orthogonal surfaces 56*aa*', 56*ba*', 56*ca*' of the first orthogonal reflector 54*a*'. The risk of damage to the top panel 12 is minimized because the edges of the orthogonal surfaces are rounded with no sharp corners, unlike the cubic radar reflector device 50. Also, since the three mutually orthogonal surfaces 56*aa*', 56*ba*', 56*ca*' are substantially the same size and shape, the central reflection vector 60*a*' of the first orthogonal reflector is substantially vertical and pointed upward and is substantially coincident with the central axis 40 of the inflatable structure 11. This ensures that the six surrounding 3-surface orthogonal reflectors 54*b*', 54*c*', 54*d*', 54*e*', 54*f* ', 54*h*' have central reflection vectors 60*b*', 60*c*', 60*d*', 60*e*', 60*f* ', 60*h*' that radiate outward toward potential radar transmitters and receivers so as to improve radar reflectivity of the buoyant target.

Figure 9:
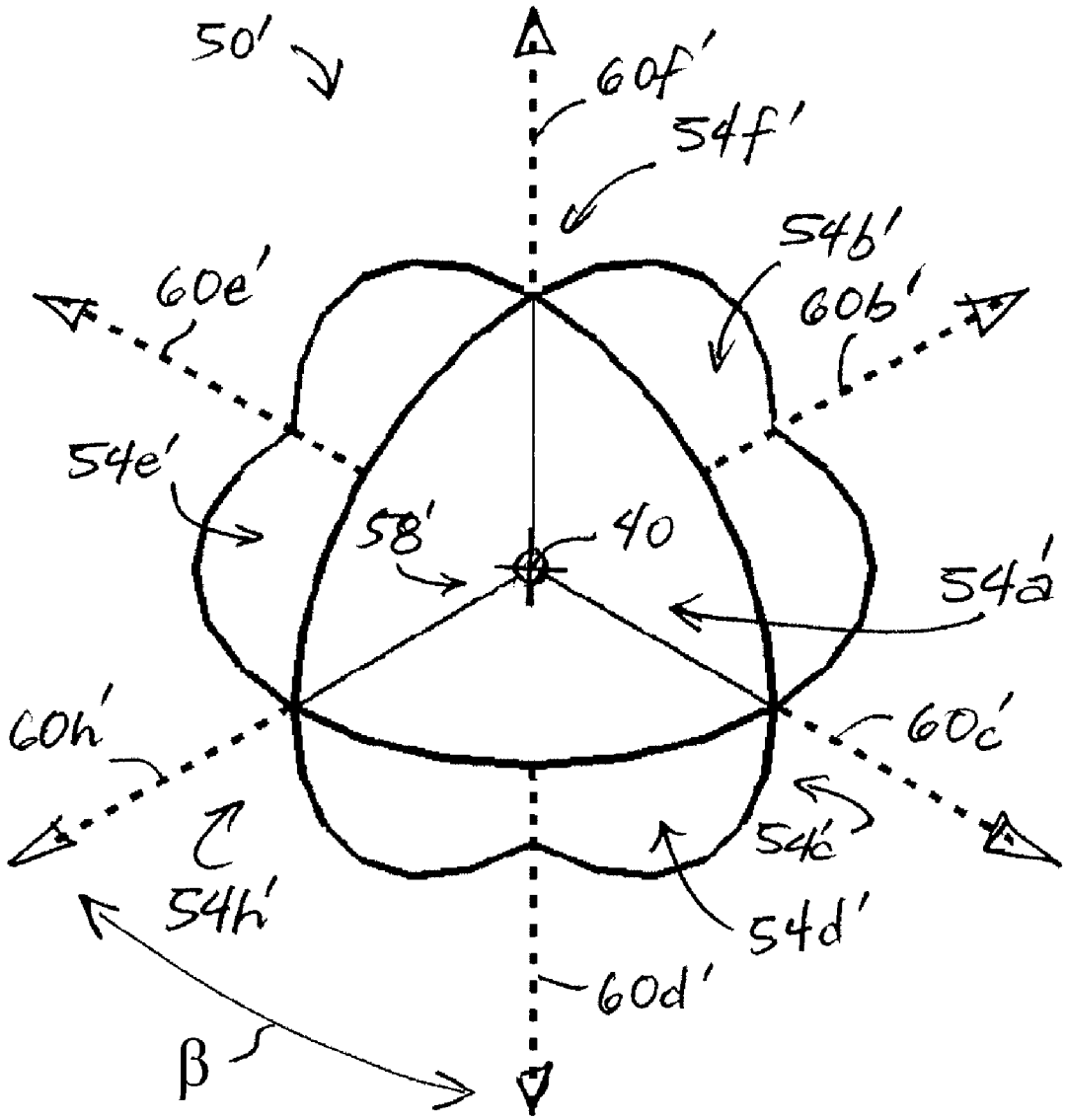
FIG. 9 is a top view of the spherical radar reflector device of FIG. 8, showing central reflection vectors, in plan view, spaced apart from each other at substantially equal angles.

FIG. 9 shows a plan view, i.e., top view, of the spherical radar reflector device 50' of FIG. 8 which has been tightly secured so as to abut the top, interior surface of the inflatable structure 11. In FIG. 9, the top panel 12, the flexible loop 78, and washers 80 are not shown for the sake of clarity. Six of the central reflection vectors 60*b*', 60*c*', 60*d*', 60*h*', 60*e*', 60*f* point outward from the center 58' of the radar reflector device 50'. In plan view, as shown in FIG. 9, the six central reflection vectors 60*b*', 60*c*', 60*d*', 60*h*', 60*e*', 60*f*' are separated from each other by substantially equal angles β of about sixty degrees. The remaining two central reflection vectors 60*a*', 60*g*' are oriented vertically and aligned with the central axis 40 of the inflatable structure 11. In other embodiments, the angles β range from about fifty degrees to about seventy degrees.

In elevation view, as shown in FIG. 8, the non-vertical reflection vectors 60*b*', 60*c*', 60*d*', 60*h*', 60*e*', 60*f* are tilted from a horizontal plane H at substantially equal angles γ of about 20 degrees. Three of the six non-vertical reflection vectors 60*b*', 60*d*', 60*e*' are tilted above the horizontal plane H. The other three non-vertical reflection vectors 60*c*', 60*f*, 60*h*' are tilted below the horizontal plane H. In some embodiments, the angles γ range from about ten degrees to about thirty degrees, and more narrowly about fifteen degrees to about twenty-five degrees. Although none of the central reflection vectors 60*b*', 60*c*', 60*d*', 60*h*', 60*e*', 60*f* are substantially horizontal, Applicant has found that this configuration of central reflection vectors—tilted from horizontal from about twenty to thirty degrees, and more preferably about 20 degrees—provides outstanding radar reflection even when the buoyant target 10 is bobbing and tilting side to side on the water.

In some embodiments, the means and method for attachment shown in FIG. 7 and described in connection with FIG. 8 are duplicated on multiple interior surfaces of the sidewall 14 of the inflatable structure 11, and a corresponding number of radar reflector devices are secured thereto to provide additional radar reflectivity to the buoyant target 10. For example, two or more of the radar reflector devices 50' can be attached to the top panel 12 within the inflatable chamber 16 of the inflatable structure 11. In another non-limiting example, radar reflector devices can be secured in contact with interior surfaces of the front, rear, right and left panels 14*a*, 14*b*, 14*c*, 14*d* of the sidewall.

In some embodiments, the means and method for attachment shown in FIG. 7 and described in connection with FIG. 8 are duplicated on multiple exterior surfaces of the sidewall 14 and/or the top panel 12. For example, radar reflector devices can be detachably secured in contact with exterior surfaces of one or any combination of the top panel 12 and the front, rear, right and left panels 14*a*, 14*b*, 14*c*, 14*d* of the sidewall.

Figure 11:
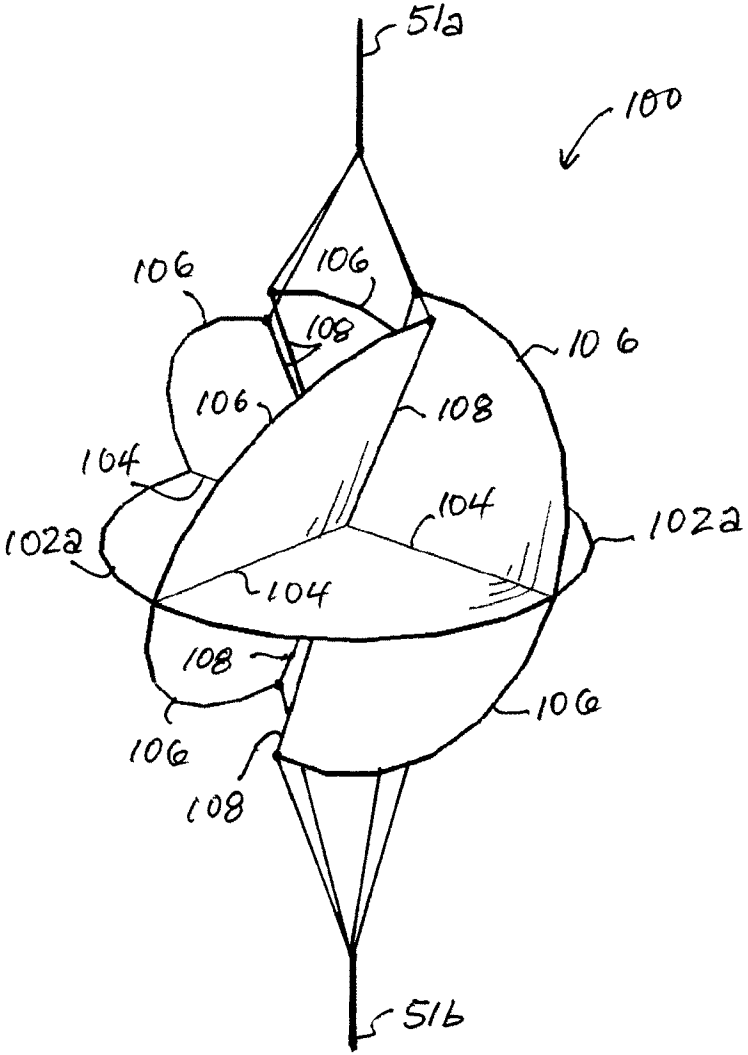
FIG. 11 is a perspective view of the folding radar reflector device of FIG. 10 in a further unfolded state, showing increased tension placed on securement lines attached to the reflective leaves.
Figure 10:
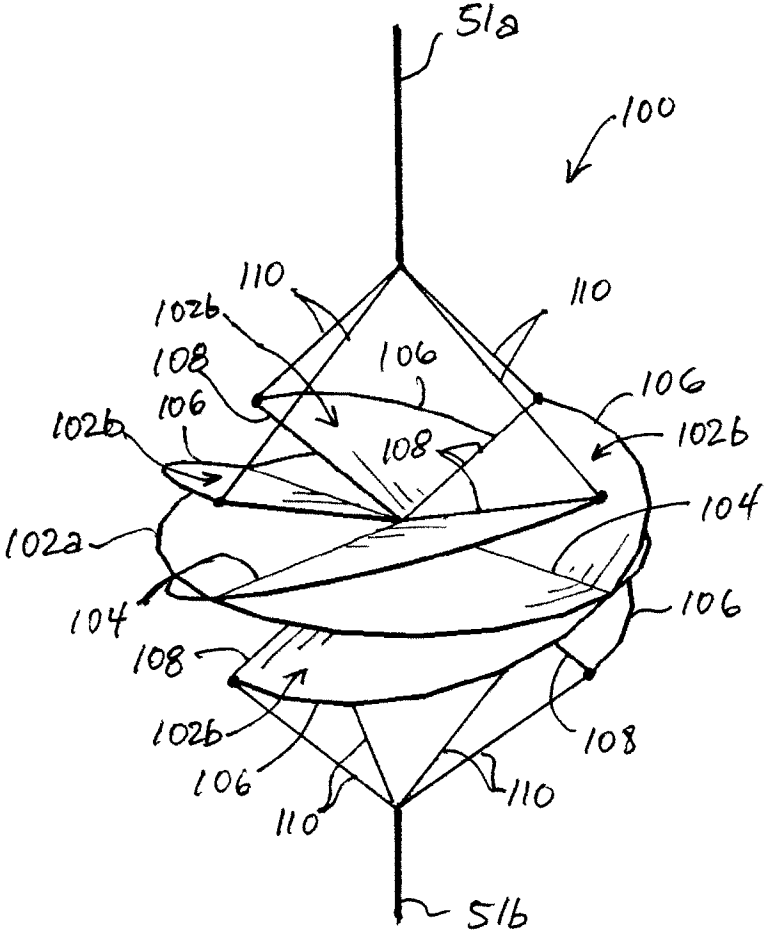
FIG. 10 is a perspective view of a folding radar reflector device in a partially unfolded state, showing movable flat reflective leaves attached to a flat reflective base.
Figure 12:
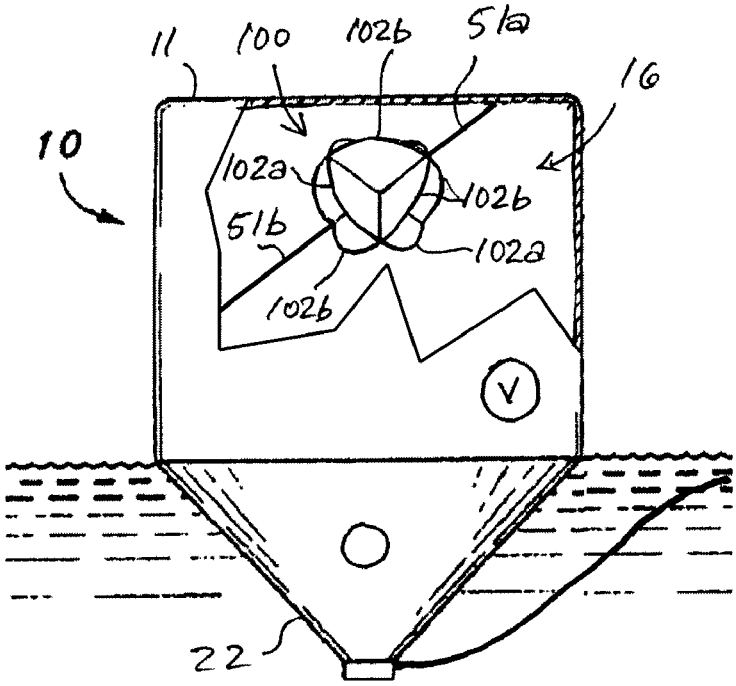
FIG. 12 is a cutaway, elevation view of a buoyant target, showing the folding radar reflector device of FIGS. 10 and 11 with the reflective leaves and the reflective base forming three mutually orthogonal planes.

FIGS. 10-12 show a folding radar reflector device 100 having reflective surfaces 102 configured to move relative to each other. The radar reflector device comprises a reflective base 102*a*, which is illustrated as horizontal in FIGS. 10 and 11, and eight reflective leaves 102*b* that attached to the reflective base 102*a*. Both sides of the base 102*a* and each leaf 102*b* are radar reflective.

Each reflective leaf 102*b* has a fixed edge 104 that is hingedly connected to the reflective base. The fixed edges 104 are substantially straight to allow the reflective leaf to easily pivot between a face-down orientation, substantially parallel to the reflective base, and an upright orientation, substantially perpendicular to the plate. There are four reflective leaves 102*b* on one side of the reflective base, and another four reflective leaves on the other side of the reflective base. For each group of four reflective leaves, the fixed edges are substantially perpendicular to each other so as to form a cross pattern on the reflective base.

Each reflective leaf 102*b* has an outer edge 106 and an inner edge 108, both of which are free to move relative to the reflective base. The inner edge 108 connects the outer edge 106 to the fixed edge 104. A cord 110 is attached to each reflective leaf at or near where the outer and inner edges meet. The individual cords for the four reflective leaves above the reflective base meet at the end of a first securement line 51*a*. The individual cords for the four reflective leaves above the reflective base meet at the end of a second securement line 51*b*. With no tension placed on the securement lines 51*a*, 51*b*, the reflective leaves 102*b* are free to collapsed to the face-down orientation onto the reflective base 102*a*. Tension on the securement lines 51*a*, 51*b* is produced by pulling the two securement lines apart and away from the radar reflector device 100. FIGS. 10 and 11 show the reflective leaves 102*b* pivoting relative to each other, and relative to the base 102*a*, as a result of different amounts of tension in the securement lines 51*a*, 51*b*, with FIG. 10 having less tension than in FIG. 11.

As tension is increased beyond that of FIG. 11, the reflective leaves 102*b* reach their fully upright orientation shown in FIG. 12 in which they are substantially perpendicular to the reflective base 102*a*. With all the reflective leaves 102*b* in their fully upright orientation, the folding radar reflector device 100 has the same structural configuration as the radar reflector device 50' of FIGS. 7-9. It will be appreciated that the reflective leaves 102*b* are capable of moving independently of each other and that tension on the securement lines 51*a*, 51*b* causes the reflective leaves 102*b* to move simultaneously to their upright orientations.

As shown in FIG. 12, the folding radar reflector device 100 can be mounted within the air-filled chamber 16 of the inflatable structure 11 of the buoyant target 10. The securement lines 51*a*, 52*b* are secured to inner surfaces of the inflatable structure 11 so that inflation of the inflatable structure 11 increases tension on the securement lines. The means and method of attachment can be the same as that described in connection with FIG. 7.

The securement lines 51*a*, 52*b* can be sized so that when the inflatable structure 11 is fully inflated, the reflective leaves 102*b* are at their fully upright orientation relative to the reflective base 102*a*. In FIG. 12, the reflective base 102*a* is not horizontal. The ends of the securement lines 51*a*, 51*b* are attached to predetermined positions on the inflatable structure 11 so that when the inflatable structure is fully inflated, the radar reflector device 100 and its central reflection vectors have the same orientation as described in connection with FIGS. 8 and 9. It should also be apparent from FIG. 12 that the securement lines 51*a*, 51*b* maintain the orientation of the radar reflector device 100 while the inflatable structure 100 remains filled with gas.

Any number of the reflective leaves 102*b* and the reflective base 102*a* can have the same construction as that described above for the orthogonal sheets 52, 52' and the reflective surfaces 56, 56' in connection with FIGS. 4-9. In further embodiments, the reflective base 102*a* and leaves 102*b* are constructed of a light-weight corrugated plastic or cardboard that is laminated on both sides with metal foil, then covered with a protective material, such as flexible fabric. The protective material near the fixed edges of the reflective leaves 102*b* are attached, such as by stitching or bonding, onto the base plate 102*a* or onto protective material covering the base plate 102*a*. The stitching or bonding forms a flexible seam, which functions as a hinge device about which the reflective leaves 102*a* may pivot between face-down and upright positions.

In some embodiments, the reflective base 102*a* and leaves 102*b* are constructed of a flexible material, such as the membrane material used for the sidewall 14, top panel 12, or bottom panel 13. A metallic foil can then be laminated or bonded onto the membrane material of the leaves and base. Changes in the amount of tension in the securement lines 51*a*, 51*b* causes all the flexible, reflective base 102*a* and leaves 102*b* to bend or flex relative to each other. When the inflatable structure 11 is fully inflated, tension in the securement lines 51*a*, 51*b* is at a level that causes all the flexible, reflective leaves 102*b* to unfurl and stretch out so that they become substantially planar and form eight 3-surface orthogonal reflectors such as shown for the reflector devices of FIG. 5-9.

It is to be understood that radar reflector devices described above are passive devices in the sense that they do not generate and/or transmit an electromagnetic signal. The radar reflector devices 50, 50', 100 require no power source, which enables the buoyant target 10 to operate indefinitely. The radar reflector devices 50, 50', 100 are configured to reflect non-visible electromagnetic radiation, such as a radar signal. The radar reflector devices 50, 50', 100 are configured to reflect radar signals having frequencies, known in the art, used for aircraft and maritime navigation and for gunnery exercises.

Figure 13:
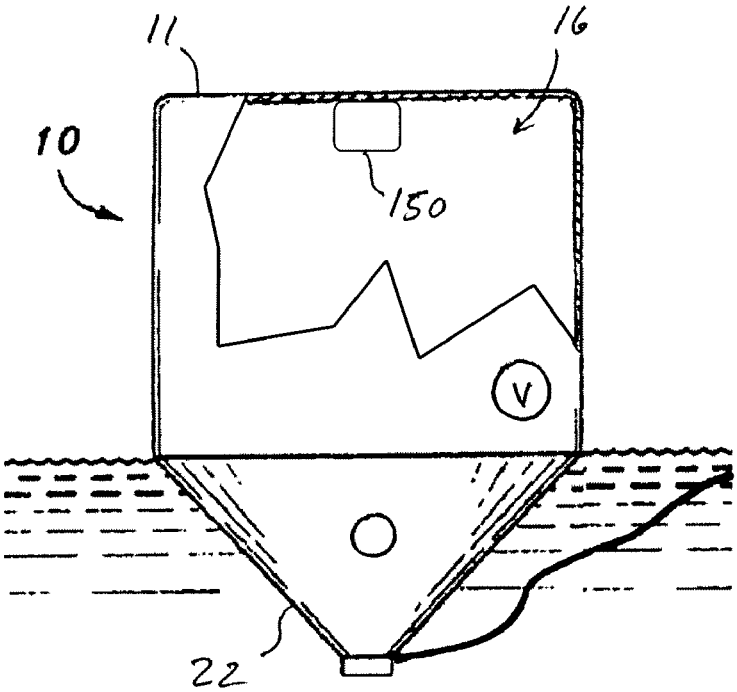
FIG. 13 is an elevation view of a buoyant target, showing an electronic device configured to transmit signals.

In FIG. 13, an electronic device 150 is attached to the interior surface of the top panel 12 and is disposed within the chamber 16 of the inflatable structure 11. The electronic device 150 is an active device that comprises a power source and electronic circuitry. Instead of reflecting an electromagnetic signal, the electronic device 150 is configured to transmit an electromagnetic signal. The electronic device 150 can be remotely controlled to selectively transmit the electromagnetic signal at a desired time. The electromagnetic signal can be transmitted by the electronic device 150 continuously and/or periodically. The electronic device 150 can be configured to monitor and receive a radar signal from an aircraft or a ship, and transmit an electromagnetic signal in response to the received signal. The transmitted electromagnetic signal can be at a frequency selected based on the received signal.

In some embodiments, the buoyant target includes no drogue chute and no tow line. No anchor device or a different type of anchor device may be attached to the inflatable structure of the buoyant target, as desired. Instead of a drogue chute, another stabilizing device can be attached to the bottom end of the inflatable structure to prevent the buoyant target from tipping over of tilting excessively due to wave motion and wind.

While several particular forms of the invention have been illustrated and described, it will also be apparent that various modifications can be made without departing from the scope of the invention. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

What is claimed is:

1. A buoyant target comprising:

an inflatable structure formed of a flexible material that allows the inflatable structure to expand from a collapsed state to an inflated state;

a radar reflector device disposed inside the inflatable structure, the radar reflector device comprising a plurality of 3-surface orthogonal reflectors configured to reflect a radar signal, each of the 3-surface orthogonal reflectors has a central reflection vector oriented at substantially equal angles from each radar reflective surface of the 3-surface orthogonal reflector; and a stabilizing structure configured to orient the inflatable structure on a water surface such that six central reflection vectors are tilted from horizontal at substantially equal angles of at least 10 degrees.

2. The buoyant target of claim 1, wherein the radar reflector device comprises three flat sheets that are substantially perpendicular to each other, and the three flat sheets form the plurality of 3-surface orthogonal reflectors.

3. The buoyant target of claim 1, wherein the six central reflection vectors point radially outward, in plan view, from the inflatable structure.

4. The buoyant target of claim 1, wherein the six central reflection vectors are spaced apart from each other, in plan view, at substantially equal angles.

5. The buoyant target of claim 1, wherein the six central reflection vectors are spaced apart from each other, in plan view, at angles from about 50 degrees to about 70 degrees.

6. The buoyant target of claim 1, wherein the stabilizing structure is configured to orient the inflatable structure on the water surface such that each of the six central reflection vectors are tilted from horizontal by about 20 degrees.

7. The buoyant target of claim 1, wherein the radar reflector device comprises at least six 3-surface orthogonal reflectors, each of the 3-surface orthogonal reflectors having three radar reflective surface that are substantially perpendicular to each other and intersect an a center point, and the center points of the at least six 3-surface orthogonal reflectors are mutually coincident.

8. The buoyant target of claim 7, wherein at least three edges of the radar reflector device abuts an interior surface of the inflatable structure, the interior surface being substantially horizontal when the inflatable structure is fully inflated and deployed on water.

9. The buoyant target of claim 1, wherein the radar reflector device comprises a plurality of reflective leaves formed of rigid material, the reflective leaves connected to each other by hinges, the reflective leaves configured to pivot or bend relative to each other at the hinges.

10. The buoyant target of claim 9, wherein a first plurality of the reflective leaves are configured to pivot or bend relative to each other at the hinges when the inflatable structure is inflated, and wherein when the inflatable structure is fully inflated the reflective leaves are substantially perpendicular to each other.

11. The buoyant target of claim 9, wherein a first plurality of the leaves are attached to an end of a first securement line, another end of the first securement line is attached to the inflatable structure, a second plurality of leaves are attached to an end of a second securement line, and another end of the second securement line is attached to the inflatable structure.

12. The buoyant target of claim 1, wherein the stabilizing structure is connected to a bottom end of the inflatable structure, the stabilizing structure including a sheet of flexible material enclosing a chamber and the sheet including an aperture that allows water to fill the chamber when placed on water.

13. A buoyant target comprising:

an inflatable structure configured to expand from a collapsed state to an inflated state when filled with gas; and a radar reflector device disposed within the inflatable structure, the radar reflector device comprising three mutually orthogonal and intersecting planes, the planes configured to reflect a radar signal, the planes forming a plurality of orthogonal reflectors, wherein each plane is bounded by an edge that forms a circle, and the edge of each plane abuts an interior surface of the inflatable structure, the interior surface being substantially flat when the inflatable structure is in the inflated state.

14. The buoyant target of claim 13, further comprising a stabilizing structure connected to a bottom end of the inflatable structure, the stabilizing structure enclosing a chamber and including an aperture that allows water to fill the chamber when placed on water, wherein the stabilizing structure is configured to fold.

15. The buoyant target of claim 14, wherein the planes form eight 3-surface orthogonal reflectors each having a central reflection vector, and wherein the stabilizing structure is configured to orient the inflatable structure on a water surface such that when the inflatable structure is in the inflated state, a first three of the central reflector vectors are tilted above horizontal at substantially equal angles of at least 10 degrees and a second three of the central reflector vectors are tilted below horizontal at substantially equal angles of at least 10 degrees.

16. The buoyant target of claim 14, wherein the stabilizing structure is configured to orient the inflatable structure on a water surface such that when the inflatable structure is in the inflated state, the first three central reflector vectors are tilted above horizontal at substantially equal angles of about 20 degrees and the second three central reflector vectors are tilted below horizontal at substantially equal angles of about 20 degrees.

17. The buoyant target of claim 13, wherein the radar reflector device comprises a plurality of reflective leaves formed of rigid material, the reflective leaves connected to each other by hinges, the reflective leaves configured to pivot or bend relative to each other at the hinges, the reflective leaves forming at least one of the three mutually orthogonal and intersecting planes.

18. The buoyant target of claim 1, wherein inflatable structure includes an interior surface that is flat and substantially horizontal when the inflatable structure is in the inflated state on the water surface, and the radar reflector device is pulled against the interior surface by a rope, cord, or tie.

19. The buoyant target of claim 13, further comprising a stabilizing structure connected to the inflatable structure, wherein each of the orthogonal reflectors has a central reflection vector oriented at substantially equal angles from each of the intersecting planes, and the stabilizing structure is configured to orient the inflatable structure on a water surface such that six central reflection vectors are tilted from horizontal at substantially equal angles of at least 10 degrees.

* * * * *